United States Patent [19]

Britzman

[11] 4,186,443

[45] Feb. 5, 1980

[54] DISPOSABLE BIB

[76] Inventor: Agnita Britzman, 1440 E. Fourth St., Long Beach, Calif. 90802

[21] Appl. No.: 935,678

[22] Filed: Aug. 21, 1978

[51] Int. Cl.[2] ..... A41B 13/10

[52] U.S. Cl. ..... 2/49 R

[58] Field of Search ..... 2/48, 49 A, 49 R, 50, 2/51, 52

[56] References Cited

U.S. PATENT DOCUMENTS

| | | | |
|---|---|---|---|
| 3,146,464 | 9/1964 | Burnett | 2/49 R |
| 3,793,644 | 2/1974 | Kellmer | 2/49 R |

*Primary Examiner*—Doris L. Troutman

*Attorney, Agent, or Firm*—Fulwider, Patton, Rieber, Lee & Utecht

[57] ABSTRACT

A disposable bib construction comprising a flat rectangular flexible sheet having strap forming slits cut along one edge thereof. A transverse median slit is cut from one side of the sheet to a spaced distance from the opposite side and a U-shaped slit is cut into the sheet around the median slit and spaced around the end thereof with its ends terminating a spaced distance from the first side of the sheet. The cut strips are deformable into a continuous neck strap having two sides and a connecting yoke. The bib is constructed of a nylon mesh reinforced flexible paper or plastic sheet material and a plurality of bibs may be assembled as a continuous roll with perforations between individual bibs.

6 Claims, 4 Drawing Figures

DISPOSABLE BIB

BACKGROUND OF THE INVENTION

1. Field of the Invention:

The present invention relates generally to inexpensive bibs and, more particularly, to an inexpensive bib having a continuous strap formed by slits in flat sheet material.

2. Description of the Prior Art:

In the prior art, some disposable bib constructions utilize slit arrangements in flat sheets to provide deformable neck straps. An example of such a construction is that shown in Kellner, U.S. Pat. No. 3,793,644, but such constructions require special preliminary shapes for the sheets before the slits were placed in the bib sheet. Other constructions required cutting away or cutting out pieces of the sheet material in order to form the neck strap. An example of this type of construction is shown in Marder et al, U.S. Pat. No. 3,416,157, and Schultz, U.S. Pat. No. 3,452,363. In these constructions, the cut out pieces result in unusable waste material. Still other prior art constructions result in nonusable or interfering flaps when the bib material is deformed into working shape. Examples of this type of construction are shown in Barager, U.S. Pat. No. 2,617,104, and Shearer, U.S. Pat. No. 3,945,048. Therefore, prior art disposable bib constructions utilizing slits in sheet material or the like have either required special shapes, the creation of waste material during construction, or unusable or interfering flaps. Thus, there has been a need for an inexpensive bib construction which would be simple and easy to construct without requiring special shapes and which would not generate waste material or the creation of unusable flaps or the like, and which is readily adaptable for use by patients confined to wheel chairs to protect their laps from food droppings during dining at a conventional dining table or while reclining in a chair or bed.

SUMMARY OF THE INVENTION

The present invention provides an inexpensive bib constructed of flat sheet material in which a neck strap is provided by means of a slit extending transversely inwardly from one side of the sheet and terminating in an end spaced from the opposite side. The transverse slit is sandwiched between a U-shaped slit having legs disposed on opposite sides thereof and terminating in ends spaced from the first side of the sheet. The connecting slit for the U-shaped slit passes between the termination of the first slit and the opposite side of the sheet. Sides and a yoke for the neck strap are formed by pulling and deforming the sheet material between the slits into a continuous neck strap.

With such a construction, the unused bib may remain rectangular in shape and in one piece and, consequently, is easy to manufacture without generating any waste material. Additionally, the rectangular shape of the bib permits a plurality of bibs to be formed as a continuous roll with perforations between individual bibs. The bib is preferably constructed of a nylon mesh reinforced plastic material for added strength.

Thus, the disposable bib of the present invention is simple and easy to manufacture either individually or as a continuous roll of bibs and may be manufactured without generating waste material by utilization of simple slits without cutouts in the material.

The objects and advantages of the present invention will become apparent from a consideration of the following detailed description when taken in conjunction with the accompanying drawing.

DESCRIPTION OF THE PREFERRED EMBODIMENT

Figure 1:
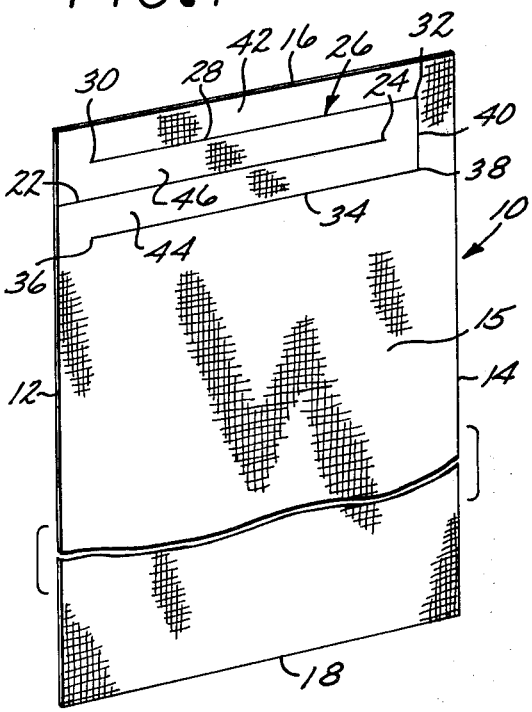
FIG. 1 is a perspective view of a disposable bib constructed in accordance with the present invention in its original undeformed state.
Figure 2:
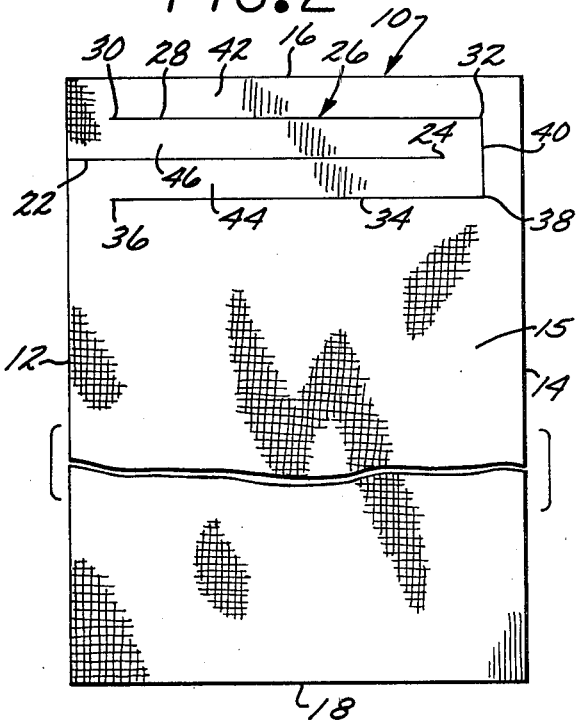
FIG. 2 is a plan view thereof.

Turning now to the drawings, particularly FIG. 1 thereof, a disposable bib 10 constructed in accordance with the present invention is illustrated in perspective. The bib 10 is preferably constructed generally rectangular in shape with elongated first and second sides 12 and 14, respectively, and somewhat shorter top and bottom edges 16 and 18, respectively. While the bib 10 may be constructed of any suitable material, it is contemplated that a nylon mesh reinforced paper or plastic material be utilized to provide not only protective cover, but to provide a bib of greater strength than unreinforced plastic sheet material.

It will be appreciated that the rectangular shape of the bib 10, particularly the straight top and bottom edges 16 and 18, are particularly adaptable for assembling a plurality of bibs in a continuous roll with individual bibs being joined with perforations along their top and bottom edges 16 and 18, respectively.

For each individual bib, a continuous neck strap 20 (FIG. 3) is formed by a series of straight slits in the sheet material adjacent the top edge 16. A straight slit 22 extends transversely from the first side 12 across the sheet material parallel to the top edge 16. The slit 22 terminates in a point 24 which is spaced a predetermined distance from the second side.

A U-shaped slit 26 surrounds the termination point 24 of the firstslit 22 and has a first leg 28 parallel and equidistant from both the first slit 22 and the top edge 16. The first leg 28 of the U-shaped slit 26 terminates at a point 30 which is spaced a second predetermined distance from the first side 12 and also terminates at a point 32 which is spaced the same predetermined distance from the second side 14.

Similarly, a second leg 34 extends parallel to the first slit 22 and is spaced a distance from slit 22 which is the same as the spacing of the first leg 28 from slit 22. Again, the second leg terminates at a point 36 which is spaced from the first side 12 the same distance as the termination point 30 of the first leg 28. The second leg 34 of the U-shaped slit 26 also terminates at a point 38 spaced from the second side a distance equal to the spacing of termination point 32 from the second side a distance equal to the spacing of termination point 32 from the second side. A cross slit 40 extends between the termination points 32 and 38 to form the connection between the first and second legs 28 and 34 of the U-shaped slit 26.

It will be appreciated that the spacing of the slits 22, 28 and 34, as well as the distance between slit 28 and the upper edge 16 is such that strips of sheet material of equal width are formed to provide first and second sides 42 and 44 respectively and a yoke 46 of the continuous neck strap. Similarly, the first and second predetermined distances of the termination points 30, 36, 32 and 38 from the first and second sides 12 and 14, respectively, are substantially the same as the widths of the sides and yoke 42, 44 and 46, respectively, to provide a neck strap of substantially the same width throughout its length, and of sufficient strength to withstand tearing during use. It is contemplated that a strap width between one-half and one inch be used, depending upon the strength of the sheet material.

Figure 3:
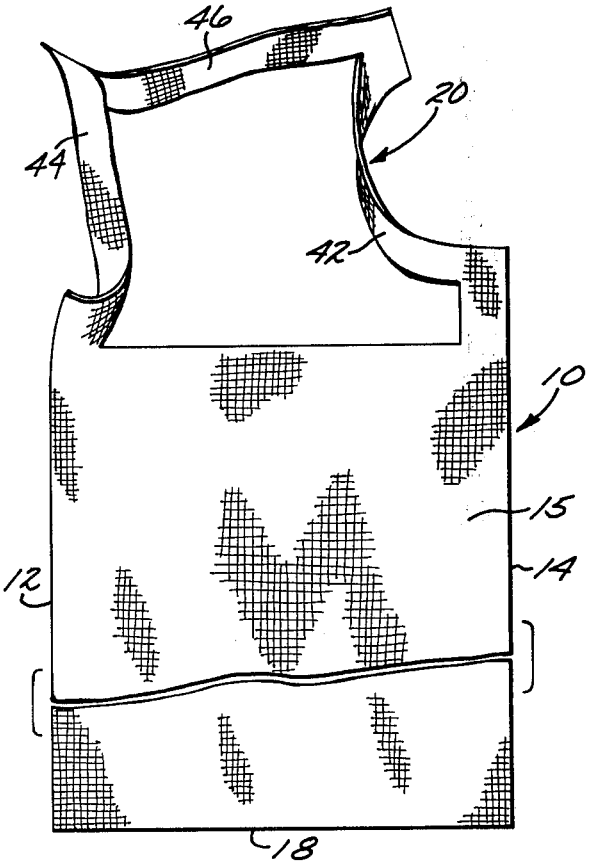
FIG. 3 is a plan view of the disposable bib with the continuous neck strap being deformed into position.
Figure 4:
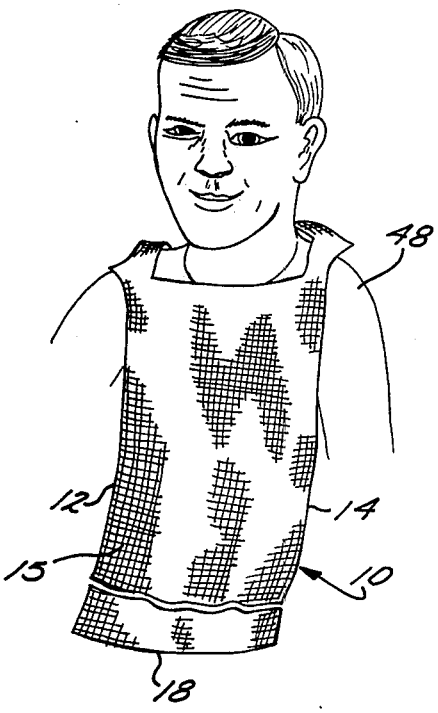
FIG. 4 is a pictorial view of a person, such as an infant, wearing a disposable bib constructed in accordance with the present invention.

The neck strap 20 is formed by pulling the first side 42 of the strap 20 outwardly and away from the main bib portion 15 which in turn gradually pulls the yoke 46 and second side 44 away from the bib section, deforming and twisting the sides and yoke into a neck strap configuration as shown in FIG. 3. As the bib material is flexible plastic and will not be subjected to extreme pulling sresses, the twisting and deformation is of no consequence and the bib 10 may be slipped over the head of the wearer, such as a child 48.

Thus, the bib 10 of the present invention is rectangular in shape and may be attached to similar bibs by perforations along the top and bottom edges 16 and 18 to provide a continuous roll of disposable bibs and the neck strap 20 is provided by means of a first slit 22 surrounded by a U-shaped slit 26 with uniform strap width distances being maintained so that pulling the first side 42 away from the bib section 15 deforms the slotted area into the continuous neck strap 20.

While a presently preferred embodiment of the present invention has been described in detail, it should be appreciated that alternate forms of constructions may utilize the present invention. Therefore, the invention is not to be limited except by the following claims.

I claim:

1. A disposable bib, comprising:

a flexible sheet having first and second sides and top and bottom edges, including a bib section and a strap section formed adjacent said top edge, said strap section having a transverse first slit extending in from said one side thereof and terminating in a first end spaced from said second side, a U-shaped slit including first and second legs disposed on opposite sides of said first slit and a cross slit between said first and second legs, said cross slit being spaced intermediate said first end and said second side, said slit legs terminating in respective second and third ends spaced from said first side whereby said slits cooperate to form a first side strap between said first slit and said second slit leg, a second strap between said first slit leg and said top edge and a yoke between said first slit leg and said first slit, said first and second side straps and said yoke forming a continuous neck strap when said second side strap is pulled away from said bib section.

2. A disposable bib as defined in claim 1, wherein: said sheet is substantially rectangular in shape.

3. A disposable bib as defined in claim 1, wherein: said first slit and said first and second legs of said U-shaped slit are parallel and equidistantly spaced from said top edge.

4. A disposable bib as defined in claim 3, wherein: the spacing between said first slit, said first and second legs of said U-shaped slit, and the spacing between said first end to said second side and the spacing between said second and third ends to said first side are substantially equal.

5. A disposable bib as defined in claim 4, wherein: said flexible sheet includes a sheet material constructed substantially of a nonporous material reinforced with a mesh material.

6. A disposable bib as defined in claim 4, wherein: said flexible sheet is substantially rectangular in shape.

* * * * *